United States Patent [19]

Lange

[11] Patent Number: 4,676,553

[45] Date of Patent: Jun. 30, 1987

[54] CHAIR AND METHOD OF MAKING SAME

[75] Inventor: Gerd Lange, Kapsweyer, Fed. Rep. of Germany

[73] Assignee: Fixtures Manufacturing Corporation, Kansas City, Mo.

[21] Appl. No.: 740,108

[22] Filed: May 31, 1985

[51] Int. Cl.[4] ..... A47C 5/00

[52] U.S. Cl. ..... 297/446; 297/239; 297/443; 297/445; 297/451

[58] Field of Search ..... 297/183, 188, 190, 191, 297/444, 443, 450, 239; D6/334, 380; 297/451, 281, 445, 446

[56] References Cited

U.S. PATENT DOCUMENTS

| | | | |
|---|---|---|---|
| D. 164,291 | 8/1951 | Duer . | |
| 198,369 | 6/1964 | Jakobsen et al. | D6/380 |
| 1,583,217 | 5/1926 | Wurdack | 297/451 |
| 2,709,484 | 5/1955 | Lamb | 297/239 |
| 3,227,487 | 1/1966 | Blanchard, Jr. et al. . | |
| 3,275,371 | 9/1966 | Rowland . | |
| 3,310,343 | 3/1967 | Schultz . | |
| 3,402,963 | 9/1968 | Fujioka et al. . | |
| 3,677,601 | 7/1972 | Morrison et al. . | |
| 3,708,202 | 1/1973 | Barecki et al. . | |
| 3,722,954 | 3/1973 | Ley et al. . | |
| 3,751,109 | 8/1973 | Dufton . | |
| 3,774,960 | 11/1973 | Blodee | 297/239 |
| 3,847,433 | 11/1974 | Acton et al. . | |
| 4,018,479 | 4/1977 | Ball . | |
| 4,097,089 | 6/1978 | Peterson . | |
| 4,199,189 | 4/1980 | Neumann | 297/445 |
| 4,542,938 | 9/1985 | Tisbo et al. | 297/445 |

FOREIGN PATENT DOCUMENTS

| | | | |
|---|---|---|---|
| 965455 | 9/1950 | France | 297/443 |

*Primary Examiner*—Kenneth J. Dorner
*Assistant Examiner*—Laurie K. Cranmer
*Attorney, Agent, or Firm*—Litman, McMahon & Brown

[57] ABSTRACT

A chair and a method of constructing same are provided. The chair includes two rear frame members manufactured from tubing having a rhomboidal cross-section. Appropriate placement of two bends in the tubing forms frame members which readily control an angle between a back of the chair and rear legs of the chair. The chair back has a ventilation space therein for comfort. The front legs of the chair are also rhomboidal and the rhomboidal sections of the front and rear legs are rotationally oriented generally at right angles to one another, for rigidity.

19 Claims, 14 Drawing Figures

Fig. 8.
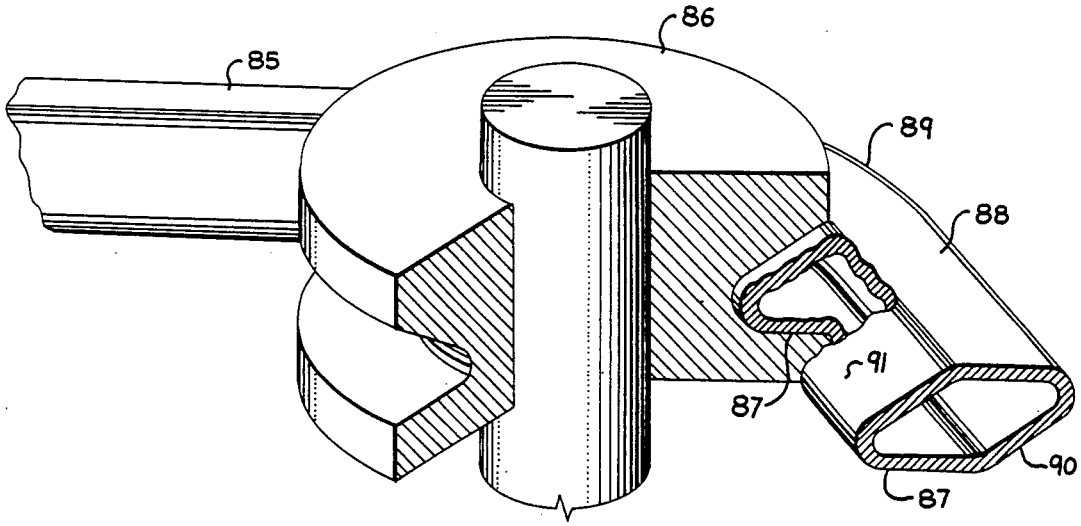
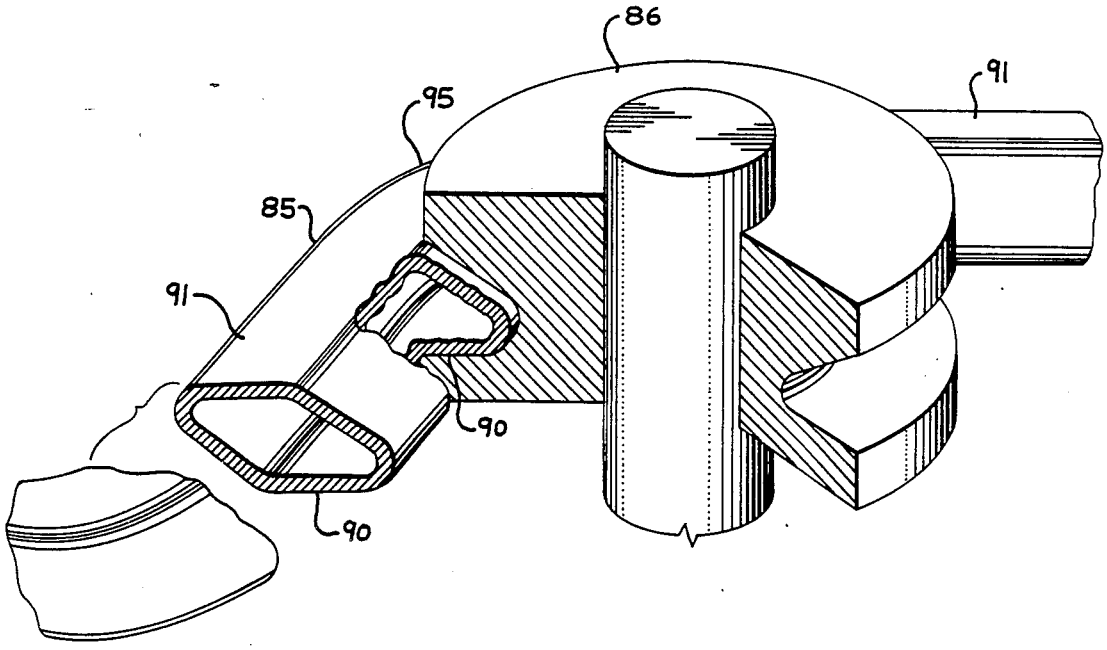
Fig. 9.

CHAIR AND METHOD OF MAKING SAME

BACKGROUND OF THE INVENTION

The present invention relates to chairs and in particular to stackable chairs of the type frequently used in convention centers, banquet halls, cafeterias, assembly rooms and the like. More specifically, the invention relates to chair configurations in which a chair back has a pre-selected angle with respect to rear legs of the chair, and the invention also relates to methods of easily, and with certainty, achieving such a pre-selected angle.

Conventional stackable chairs generally comprise a seat mounted upon a frame, at an appropriate orientation for use by a person desiring to sit on the chair, and a chair back extending generally upwardly and rearwardly from the chair seat, for use as a backrest. Generally, the angle between the backrest and the chair seat is important because it is related to the comfort of a person sitting on the chair.

Most conventional chairs have four legs, a front pair of legs and a rear pair of legs. Generally, the legs extend downwardly and outwardly from the chair seat. Such chairs often have a plane of symmetry with right and left symmetrical sides, which are mirror images of each other.

As the name implies, stackable chairs are generally capable of nesting with one another, with one chair being stacked upon another. This enables easy storage and shipping. It is preferred that the chair structure not include features which would either inhibit ease of stackability or generally cause damage to one of the chairs during stacking.

Frequently, the frames of conventional stackable chairs include tubular pieces appropriately bent for use in a chair frame. Generally, each bend requires the use of a die, so that all chairs will be uniformly constructed and easily capable of stacking with one another. In some conventional chairs, numerous, different, bends have been necessary, requiring several expensive bending operations.

In some conventional chairs, the bent frame members have relatively elaborate configurations and could be both hard to form and hard to manipulate. Further, if numerous pieces are necessary, chair construction can become more expensive.

Another problem resulting from relatively complex chair frame configurations, and the use of numerous pieces in forming chair frames, is that the frames may lose their overall strength with each added bend, weld or mechanical connection. This can lead to an increased chance of structure failure during use.

With conventional chair designs, a chair back and chair seat are usually mounted on a tubular chair frame. Often, more complex chair frames may make mounting of the chair seat or chair back more difficult. Also, proper orientation of the chair back with respect to the chair seat, may necessitate relatively complex mounting means.

The above problems have never been satisfactorily addressed by chair designs, until the present invention, in a chair which is both relatively inexpensive to produce and easy to assemble.

OBJECTS OF THE INVENTION

Therefore, the objects of the present invention are to provide a chair configuration having a back, seat, and frame with a relatively easy to achieve, pre-selected, angle between the chair back and the seat; to provide such a chair in which the chair frame includes first and second rear support members each having a rear leg portion and an upper back portion with the dihedral angle therebetween dictating the angle of the chair back to the chair seat; to provide such a chair in which the rear support members have a generally rhomboidal cross-section with an obtuse internal angle thereof generally controlling, and being substantially equivalent to, the dihedral angle between the chair back and the lower leg portion of each rear support member; to provide such a chair with a ventilation space in the upper back portion thereof; to provide such a chair having four legs, all four legs being formed from tubular material having a rhomboidal cross-section; to provide such a chair in which the rear legs have acute rhomboidal angles along side edges thereof, thus having greater strength with respect to force directed against the sides of the chair, than from front or rear directed force on such chair; and, wherein said front legs are oriented with said acute rhomboidal edges along front and rear portions thereof, thus giving the front legs a substantially increased strength with respect to force directed against a front or rear of said chair, than with respect to lateral force directed against said chair, said combination of front and rear legs generally providing strength with respect to force from any lateral direction; to provide such a chair having a ventilation space in the lower back region for comfort; to provide such a chair having an attractive appearance; to provide such a chair having an upper horizontal member for structural rigidity; to provide such a chair which is relatively inexpensive to produce; to provide such a chair which is easy to manufacture, and which is particularly well adapted for the proposed usages thereof; and to provide methods of constructing chairs having the desired features and characteristics listed above.

Other objects and advantages of this invention will become apparent from the following description taken in connection with the accompanying drawings wherein are set forth, by way of illustration and example, certain embodiments of this invention.

SUMMARY OF THE INVENTION

A chair is provided for use in convention centers, banquet halls, assembly rooms and the like. The chair is readily stackable for ease of storage or moving. The chair includes a frame having first and second rear support members, each of which acts as a rear leg and as a central support member for a back of the chair. The angle of the chair back with respect to the rear legs of the chair is directed by the configuration of the chair frame rear support members. The rear support members are preferably tubular and are substantially rhomboidal in cross-section; and, according to the present invention, the angle between the chair back and the chair seat is controlled by the internal angles of the rhomboidal tubes from which the chair frame rear support members are constructed. A method of constructing the chair is also provided.

The chair includes a frame, a seat and a chair back. The chair back includes first and second laterally spaced backrest panels; the space between the backrest panels providing a central ventilation space in the back of the chair. The chair back and seat are supported by the chair frame in appropriate orientation for use by a person sitting in the chair.

The chair frame includes four primary structural members, each of which is preferably manufactured from a length of tubular material having a rhomboidal crosssection. Preferably, the four frame members comprise a pair of front leg members which are mirror images of one another, and a pair of rear support members which are mirror images of one another.

The rear support members each include three sections: a lower section which forms a rear leg of the chair; an upper section which supports the chair back; and a central transition section extending between the lower and upper sections. As is seen from the detailed description and the drawings, it is the dihedral angle between the lower section and the upper section of the rear support members which defines the angle at which the chair back is mounted on the chair.

According to the invention, each rear support member is manufactured from a piece of tubular material having a rhomboidal cross-section and four flat outer surfaces. Accordingly, the tubular material has two substantially opposite and equal obtuse internal angles, two substantially opposite and equal acute internal angles, and four substantially flat outer surfaces. The four outer surfaces include two pairs of surfaces defining first and third generally parallel surfaces and second and fourth generally parallel surfaces.

Construction of either of the rear support members generally requires several equal bends in a piece of a tubular material. Preferably, the bends result in slightly obtuse angles, that is angles slightly greater than ninety degrees, in the tubing. In the preferred embodiment each angle is about 103 degrees, although variations are acceptable.

The first bend is made in an appropriate location, from an end of the tubular material, for the straight portion between the bend and the end of the tubular material to be a rear leg of the chair. The bend is made in the plane of the first flat side of the tube. In the preferred embodiment, the first bend begins approximately 17 inches (in.) or about 43 centimeters (cm.) from a first end of the tube.

The second bend is generally equivalent to, and opposite in direction from, the first bend and is located farther from the first end of the tube than is the first bend. In the preferred embodiment, the second bend begins about 6 in. or about 15 cm. beyond the end of the first bend.

According to the invention, the second bend is made in the plane of the second flat surface of the tube. This results in a nonplanar configuration for the tube with three extension sections: a first section between the first end of the tube and the first bend; a second section between the two bends; and a third extension beyond the second bend. It is readily seen that the dihedral angle between a first section and a third extension is approximately equivalent to, and controlled by, the obtuse internal angles of the rhomboidal tube. It is further understood that because the bends were approximately equal, the first section and the third extension are generally parallel to one another, and would be coplanar but for the dihedral angle. As will be seen, the result of the two bends is that the dihedral angle controls the angle of the back of the chair relative to the rear legs of the chair. Selective orientation of the rear support members, in the chair frame, permits control of the angle of the chair back with respect to a substantially horizontally mounted chair seat.

It will be understood that while the two bends have been referred to as a first bend and a second bend, there is no strict requirement regarding which is actually made first.

The first and second bends may be made in the same bending apparatus, with the same die, by simply changing the orientation of the rhomboidal tube. Thus, construction of the support members is easily achieved. Preferably, the third extension has a third bend therein, near an end of the support member, which is equivalent to the other bends and is in the plane of the second flat surface. Preferably, the third bend is in the same direction as the second bend, leaving a "C" shaped configuration in an upper portion of the support member. The third bend results in a top end lateral extension which, as seen below, enables ease of mounting of a chair back on the chair frame.

In the preferred embodiment, the chair back includes first and second laterally spaced backrest portions. The first backrest portion is mounted on the first support member third extension and the second backrest portion is mounted on the second support member third extension. Spacing between the backrest portions provides for ventilation in an upper and central portion of the chair back. This promotes comfort for persons using the chair for long periods of time.

In the preferred embodiment, the backrest portions are generally trapezoidally shaped. As will be seen in the following description of the drawings, this promotes easy construction and results in a large ventilation space in the lower back region of the chair back, again promoting comfort for persons utilizing the chair for long periods of time.

Also in the preferred embodiment, a horizontal extension member is mounted on, and extends between, upper ends of the two rear support members. The horizontal extension member ties the rear support members together, and provides a handle by which the chair may be easily lifted and carried.

Rhomboidal tubing has a much greater propensity to bend in certain directions than in others. Specifically, the tubing may have a significant propensity to bend into, and out-of, a plane generally bisecting the acute angles, but will be significantly resistant to bending in a direction into, and out-of, the plane generally bisecting the obtuse angles. In fact, rhomboidal tubing may be very strong with respect to this latter bending. In the preferred embodiment, the rhomboidal rear legs of the chair are generally oriented for increased resistance to bending, or crimping, with respect to force directed against sides of the chair. Preferably, the front legs of the chair are also constructed from rhomboidal tubing and they are oriented with the rhomboidal cross-section generally at right angles to the rear legs, so that the front legs will be substantially resistant to bending from force directed against the front or rear of the chair. Thus, the overall combination of front and rear legs provides for significant resistance to bending.

The method according to the present invention comprises manufacturing the chair above described, according to steps including forming the appropriate bends in rhomboidally shaped tubing.

The drawings constitute a part of this specification and include exemplary embodiments of the present invention and illustrate various objects and features thereof.

BRIEF DESCRIPTION OF THE DRAWINGS

FIG. 8 is an enlarged, fragmentary view showing a bend being formed in tubing according to a method of preparing the chair frame of FIG. 2 to construct the chair of FIG. 1; Portions are broken away to show internal detail.

FIG. 9 is an enlarged, fragmentary perspective view showing the introduction of a second bend into tubing according to a method of making the frame of FIG. 2 for construction of the chair of FIG. 1; Portions are broken away to show internal detail.

DETAILED DESCRIPTION OF THE PREFERRED EMBODIMENT

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but rather merely as a basis for the claims and as a representative basis for teaching one skilled in the art to variously employ the present invention in virtually any appropriately detailed structure.

Figure 1:
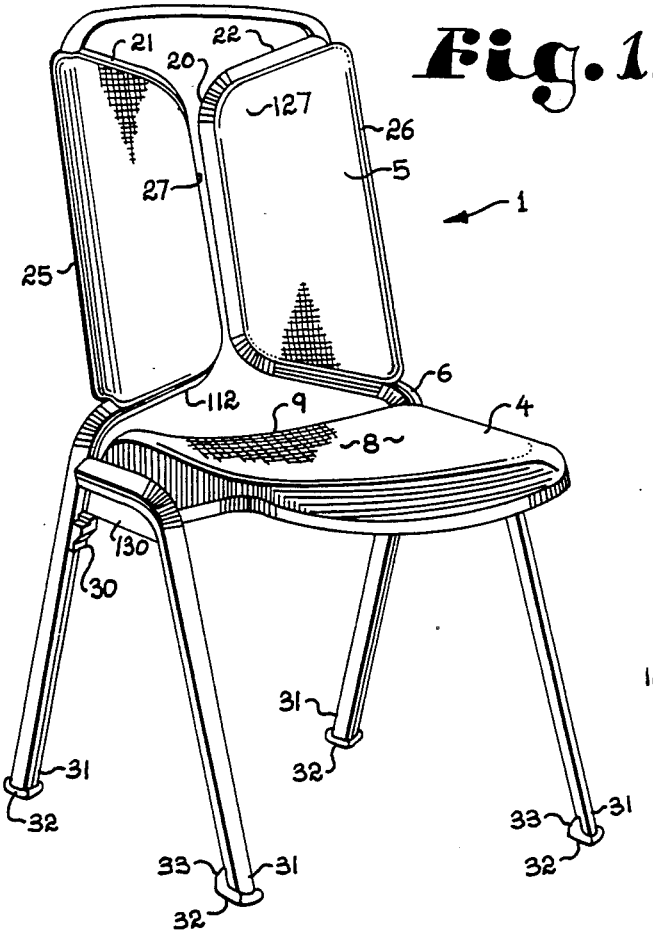
FIG. 1 is a perspective view of a chair according to the present invention.

The reference numeral 1, FIG. 1, generally designates a chair having the features of, and made according to, the present invention.

The chair 1 includes a seat 4 and a back or backrest 5. The seat 4 and backrest 5 are supported by a chair frame 6 in an appropriate position for comfortable use by a person sitting on the chair 1. Generally, this requires that the seat 4 have a substantially horizontal upper surface 8, and also that the chair 1 have the chair back 5 extending upwardly and rearwardly from a rear edge 9 of the chair seat 4. Preferably, the chair seat 4 and the backrest 5 are upholstered and cushioned for comfort.

Figure 2:
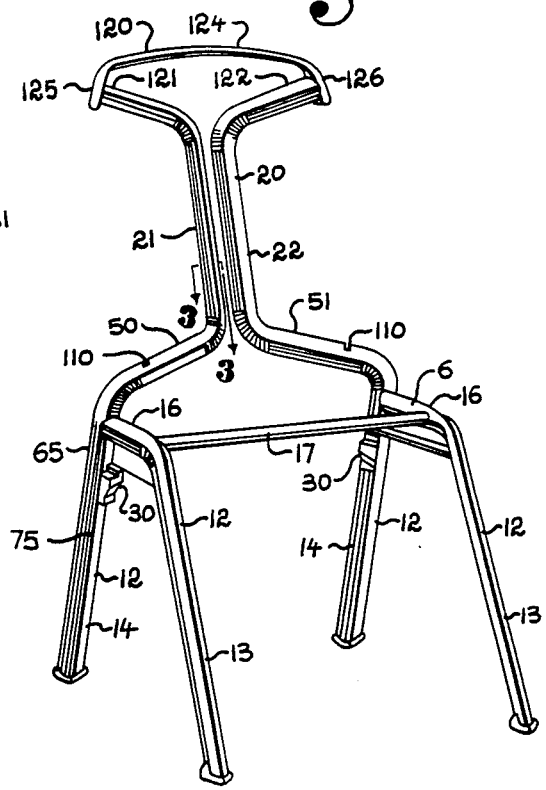
FIG. 2 is a perspective view of a chair frame of the chair of FIG. 1.
Figure 5:
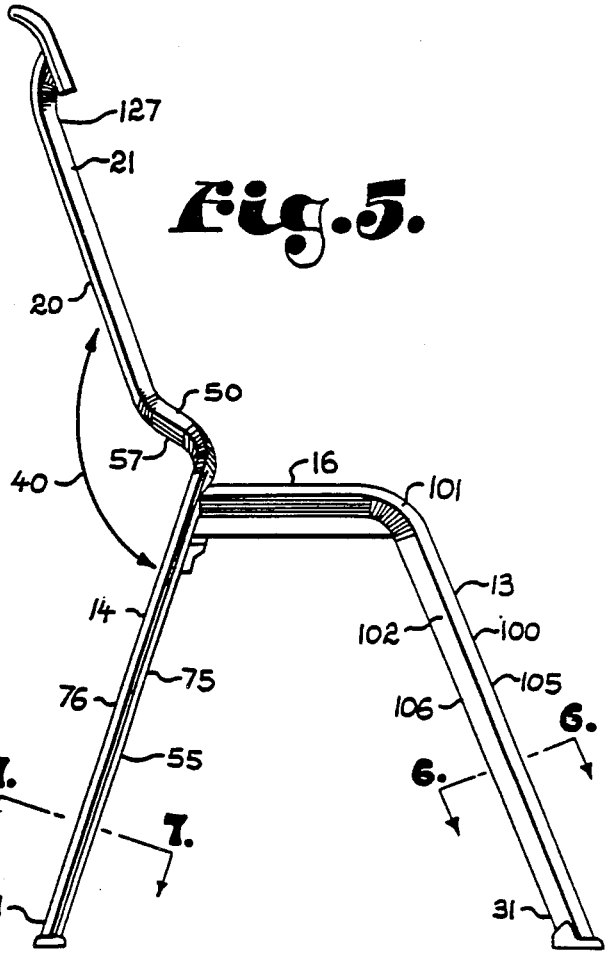
FIG. 5 an enlarged, side elevational view of the chair frame shown in FIG. 2.
Figure 7:
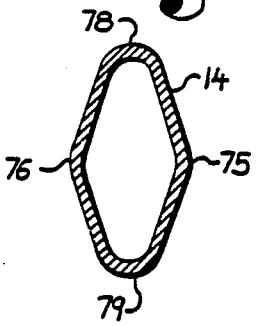
FIG. 7 is an enlarged, top fragmentary cross-sectional view taken generally along line 7—7 of FIG. 5.

The frame 6 includes support means suitable for supporting the seat 4 at an appropriate distance above a floor for comfortable use. In the preferred embodiment, FIG. 2, the frame 6 includes four legs 12. The legs 12 include a pair of front legs 13 and a pair of rear legs 14. Referring to FIG. 2, the front legs 13 extend downwardly and forwardly from side extension members 16. Referring to Fig. 5, the rear legs 14 extend downwardly and rearwardly from the side extension members 16.

Referring again to FIGS. 1 and 2, the seat 4 is mounted upon the side extension members 16 by cross bar 17. The cross bar 17 also adds to the strength of the chair 1.

Referring to FIG. 2, the chair frame 6 includes an upper back portion 20 upon which the backrest 5 is mounted, FIG. 1. In the preferred embodiment, the upper back portion 20 includes first and second extension members 21 and 22. Preferably, the chair back 5 includes a first panel or cushion 25 mounted upon the first extension 21 and a second panel or cushion 26 mounted upon the second extension 22. A ventilation space 27 between the panels 25 and 26 promotes comfort of a person utilizing the chair.

A particular advantage to the present invention is that all of the features described are accommodated by a chair frame 6, and chair 1, which is easily stackable. That is, the chairs are capable of nesting with one another, for ease of movement and storage. Referring to FIGS. 1 and 2, stack blocks 30 mounted on the rear legs 14 protect the chairs during stacking.

The chair legs 13 and 14 are preferably formed from a tubular material. The ends 31 of the legs 13 and 14 may therefore have sharp edges on them which can damage the floor. Glides 32 mounted on the ends 31 of the legs 13 and 14, protect the floor from sharp edges on the ends 31. The glides 32 on the front legs 13 include glide extensions 33 which protect the chair 1 during stacking.

One of the primary advantages of the present invention is that it permits pre-selection of, and control of, the angle of the chair back 5 within the Chair 1, FIG. 1. An alternative way of looking at this angle is to consider it as related to a dihedral angle between the upper back portion 20 of the frame 6 and the rear legs 14 of the chair 1. This dihedral angle is shown in FIG. 5, by the double headed arrow 40. This angle is particularly important with respect to the comfort of individuals utilizing the chair 1.

Figure 4:
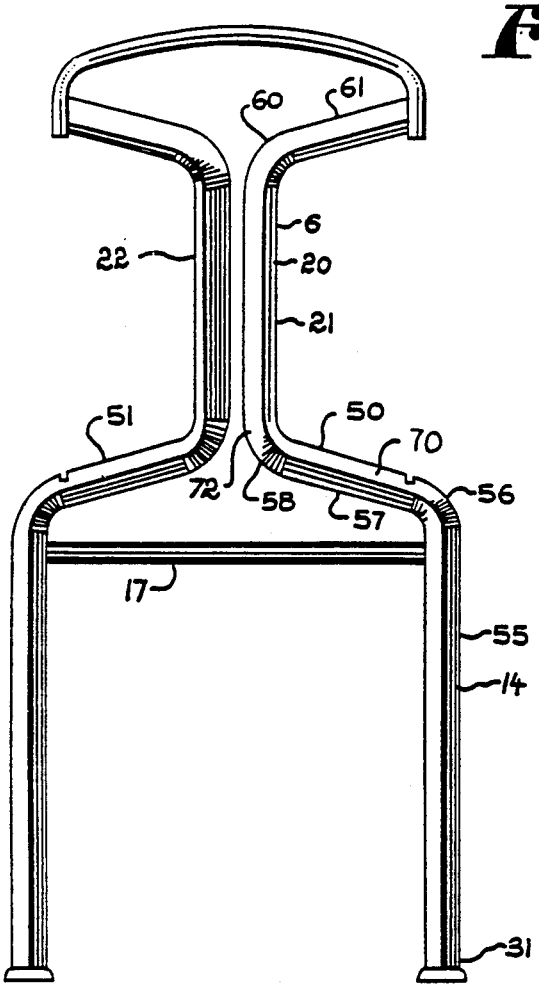
FIG. 4 is an enlarged, rear elevational view of the chair frame shown in FIG. 2.

Referring to FIG. 2, and the rear view of the chair frame 6, FIG. 4, the chair frame 6 includes first and second rear support members 50 and 51 respectively. Preferably, the rear support members 50 and 51 are mirror images of one another and are mounted on the chair 1 with a plane of symmetry passing therebetween, FIG. 4. In the preferred embodiment, each support member 50 or 51 is made from a single piece of structural material having suitable strength and having appropriate bends therein to form the desired configuration.

Referring to FIG. 4, the first rear support member 50 includes a lower extension 55 which comprises a rear leg 14 of the chair. The rear leg 14 extends between the end 31 of the rear support member 50 and a first bend 56 in the rear support member 50. Beyond the first bend 56 is an extension 57 which forms a transition portion between the rear leg 14 and the first extension 21 in the upper back portion 20 of the chair frame 6. The central extension 57 ends in a second bend 58 which, as will be understood from the following description, is preferably an opposite bend to the first bend 56, and which is approximately equal in angle, giving the support member 50 a somewhat "S" shaped configuration.

The extension 21 in the upper back portion 20 begins at the end of the second bend 58 and extends generally upwardly along a central back portion of the chair frame 6. In the preferred embodiment, FIG. 4, the first rear support member 50 includes a third, upper, bend 60 and a top end extension 61. Preferably, the angle of bend 60 is approximately that of angle 58, for ease of construction of the chair.

As is readily understood by reference to FIG. 4, and the previous description, the second rear support member 51 is a mirror image of the first rear support member 50 and includes analogous portions.

Referring again to FIG. 4, a rear elevational view of the chair frame 6, when viewed in this orientation, the first rear support member upper extension 21 appears to be parallel to the first rear support member first lower extension 55. This results from bends 56 and 58 being generally equal and opposite. However, reference to FIG. 5, a side elevational view, shows that extension 21 is not coplanar with extension 55, and that a twisting takes place through the central extension or transition portion 57. This twisting, it is readily seen, results in the selected angle 40. It is a feature of the present invention that the angle 40 can be introduced relatively easily and accurately, giving a desired and reproducible angle between the chair back 5 and chair legs 14. Also, if the rear support members 50 and 51 are always supported in the same orientation, the angle between the chair back 5 and chair seat 4 will be similarly controlled.

Figure 3:
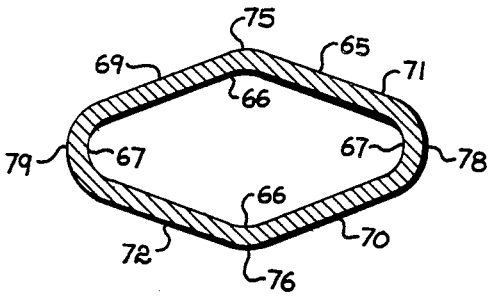
FIG. 3 is an enlarged, fragmentary, top cross-sectional view taken along line 3—3 of FIG. 2.

Referring to FIGS. 2 and 3, in the preferred embodiment, the rear support members 50 and 51 are formed from an extension of tubular material 65 having a rhomboidal cross-section FIG. 3. As with any rhomboidally shaped material, the tube 65 has two substantially equal and opposite obtuse internal angles 66 and two substantially equal and opposite acute internal angles 67. As a result, the tubular piece 65 has four outer flat surfaces comprising first and third planar surfaces 69 and 70 respectively, and second and fourth planar surfaces 71 and 72 respectively. Due to the rhomboidal cross-section of the tubular material 65, the first and third surfaces 69 and 70 are generally parallel with respect to one another, and the second and fourth surfaces 71 and 72 are also parallel with respect to one another. Between the flat surfaces are obtuse ridges 75 and 76 and acute ridges 78 and 79.

As will become apparent from the following described method of bending the tubular material 65 to form each of the rear support members 50 and 51, the obtuse angle 66 of the tubular material 65 will generally dictate, and be equivalent to, the dihedral angle 40 between the first lower extension 55 and the corresponding upper back extension 21 in the chair frame 6.

Dihedral angle 40 is introduced as follows:

Referring to FIG. 4, first bend 56 is made in the plane of flat tubular outer surface 69. Second bend 58, however, is made in the plane of the fourth flat outer surface 72. Referring FIG. 3, the angular difference between the planes of flat side 69 and 72 is controlled by the internal angles 66 and 67 of the rhomboid. The result of the two bends will generally be that the upper back portion extension 21 forms a dihedral angle with the first lower extension 55 which is controlled by, and approximately equal to, the obtuse internal angle 66 of the rhomboidal cross-section of the tubular material 65.

In other words, the transition portion between the rear leg 14 and the first extension 21 is formed by a first bend in the plane of one of the flat tubular outer surfaces and a second bend in the plane of another of the flat tubular outer surfaces extending at the obtuse angle 66 to the first plane.

It will be readily understood that when it is said that the first bend 56 is in the plane of surface 69 it is meant that the plane of bending can be either that of the surface 69 or its opposite, parallel surface 70, and that when it is said that the plane of the second bend 58 is that of the surface 72, that the second bend 58 can be in the plane of either the second surface 72 or its companion parallel surface 71. It will also be readily understood that the second rear support member 51 is made in a similar manner to the first rear support member 50, but with opposite bends to result in the mirror image configuration.

It has been found that a preferred angle for the dihedral angle 40 is about 144 degrees and results from a piece of tubular material having an obtuse internal angle of about 144 degrees and an acute internal angle of about 36 degrees. It is understood that the vertices of the rhomboidal angles, especially the acute internal angle, are rounded somewhat for ease of construction.

As indicated above, preferably the first and second bends 56 and 58 are of the same degree and, in the preferred embodiment, they are slightly obtuse, and preferably about 103 degrees.

In the preferred embodiment the tubular material 65 has an outside width, at its widest point, of about 1⅜ in. or about 3.5 cm. The first bend 56 begins about 17 in. or about 43 cm., from the end 31 of the first rear support member 50. The second bend 58 begins about 6 in., or about 15 cm., beyond the end of the first bend 56. The third bend 60 begins about 9 in. or about 23 cm., beyond the second bend 58. The length of the top end extension 61 is approximately 5 in. or about 11.4 cm.

Referring to FIGS. 8 and 9, the method of manufacturing rear support members 50 and 51 is relatively straightforward, since all three angles of bends 56, 58 and 60 are approximately equal and may be achieved in the same die and with the same bending apparatus. In FIG. 8, a bar, or extension of tube, 85 is received within a die 86 during bending. The bending is being shown to take place in the plane of surface 87, or its opposite coplanar surface 88. In FIG. 8, bend 89 is made by a tube bending apparatus, not shown, used in conjunction with the die 86.

In FIG. 9, a second bend 95 is being made in the tube 85. The bending is now in the plane of side 90 or its opposite coplanar surface 91. Extension 85 in FIG. 9 will be understood to be similar to either one of the rear support members 50 and 51, during the formation of the two bends 56 and 58. It is readily seen that rotation of the tube 85 is the key factor in orienting the tube 85 for a second bend, and the same bending apparatus and die 86 may be repeatedly used.

The third bend 60 is not shown being formed, but it will be readily understood to be put into the tube 85 in a manner similar to bend 58, FIG. 4.

Referring to FIG. 5, the rear support member 50 is oriented with the outer obtuse ridge 75 facing the front of the chair 1 and with outer obtuse ridge 76 facing the rear. This results from the bending described above and the orientation of rear support member 50 appropriately in the chair frame 6.

A feature of rhomboidal tubing is that it is more resistant to bending in one direction than it is in another. Specifically, rhomboidal tubing is much more resistant to force applied in a direction toward the acute angles that it is with respect to force directed toward the obtuse angles. In fact, rhomboidal tubing can be very resistant to bending from pressure in the appropriate direction, i.e. against the acute angles. Referring to FIG. 5 it will be understood that with the rear legs 14 oriented in the manner shown, the rear portion of the chair frame 6 will be significantly resistant to bending from force directed against the sides of the chair, or against the acute ridges 78 and 79.

In the preferred embodiment, the front legs 13 are also formed from rhomboidal tubing. Preferably, rhomboidal tubing used to make the front legs 13 is identical to that used in the rear legs 14.

Referring to FIG. 5, preferably each front leg 13 and its associated side extension member 16 is constructed from a single elongate piece 100 of the rhomboidal tubing with a single bend 101 therein. In the preferred embodiment, bend 101 is made in the plane of flat surface 102, is slightly obtuse, and is preferably about 103 degrees, so that it may be made in the same bending apparatus as the other bends. Also, preferably the bend 101 begins approximately 15 in, or 38 cm., from the end 31 of the front leg 13 and the side extension member 16 extends for approximately 6 in., or 15 cm., beyond the bend 101.

Figure 6:
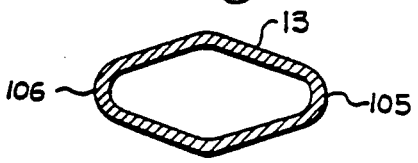
FIG. 6 is an enlarged, fragmentary top cross-sectional view of the chair frame taken generally along line 6—6 of FIG. 5.

Referring again to FIG. 5, and the cross-section of FIG. 6, the front leg 13 rhomboidal cross-section is preferably oriented at roughly 90 degrees, or at about a right angle, to the rear leg rhomboidal cross-section. Thus, referring to FIG. 5 and FIG. 6, the front leg 13 has acute ridges 105 and 106 oriented generally toward the front and rear of the chair 1. In this manner the front legs 13 will be substantially more resistant to bending from force directed generally toward the front or rear of the chair, than they are to pressure directed against a side of the chair. It will be understood that the relative orientations of the front and rear legs, 13 and 14, respectively, ensures the chair 1 will be generally stable with respect to force applied from almost any lateral direction, including both sides, the front, and the rear.

The piece of the material 100 which comprises either one of the front legs 13 and side extensions 16 may be attached to the rear support member 50 or 51 as by welding or the like. By reference to FIG. 2, it is understood that the rear leg 14 presents a relatively flat surface, in the area of the front obtuse ridge 75, for the welding to take place. Preferably, the front piece 100 is oriented with the flat surface 102 in a substantially vertical plane, or directly facing the viewer in FIG. 5, for attractiveness and ease of manufacture. Also, as a result, a flat surface, FIG. 2, is presented to the central cross bar 17 for welding.

Referring to FIG. 4, the upper portion of first rear support member 50 is generally "C" shaped, with the "C" being formed by extensions 57, 21 and 61. The extensions outline a receiving area for panel 25, FIG. 1. The panel is generally trapezoidal shaped and is supported on 3 sides by the rear support member 50. Similarly, panel 26 is supported by the second rear support member 51.

Referring to FIG. 2, notches 110 in the rear support members 50 and 51 are used for engagement of the panels 25 and 26 with a frame 6. Preferably, each panel 25 and 26 includes a spring loaded pin, not shown, which selectively engages one of the notches 110, retaining the panel 25 or 26 on the chair frame 6.

Referring to FIG. 1, it is readily seen that a ventilation area 112 is left in the lower back portion of the chair 1 between the chair seat 4 and the chair back 5. This large ventilation area is in the lower back region of a person utilizing the chair 1 and provides for significant added comfort. A large ventilation space 112 results from the selection of an obtuse angle for bend 56 in the first rear support member and its analogue, an identical obtuse angle, in the second rear support member 51.

Referring to FIG. 2, a horizontal frame member 120 extends between ends 121 and 122 of the rear support members 50 and 51 respectively. The horizontal support member 120 includes a generally horizontal extension 124 and two downwardly projecting ends 125 and 126. Preferably, the horizontal member 120 is mounted by welding or the like. The horizontal member 120 ties support members 50 and 51 together, and it also provides a handle by which the chair 1 may be lifted and moved. The horizontal member 120 need not be, and indeed is not shown to be, made from tubular material having a rhomboidal cross-section.

As is understood by reference to FIG. 1, and the above descriptions, the chair 1 not only includes the numerous advantages discussed but is also very attractive in appearance, presenting a unique symmetry. The use of the rhomboidal tubing: permits most of the structural framework to be manufactured from the same tube; yields relatively strong legs with resistance to collapse from the directions discussed; directs the angle of the back of the chair 5 with respect to the rear legs 14 or seat 4; enables the ventilation spaces 27 and 112 to be relatively easily introduced into the chair back 5; permits ease of mounting of the panels 25 and 26 on the chair frame 6; permits bending of the tubing, in a preferred embodiment, with only the requirement of a single die and bending apparatus; avoids mechanical features which are relatively expensive or which may interfere with ease of stackability of the chairs; and permits the chair 1 to be relatively easily manufactured. Also, as is understood by reference to FIGS. 1 and 5, the tubular material and frame 6 combined with panels 25 and 26 result in a chair backrest 5 which has a concave side 127 which faces the chair seat 4, and gives greater comfort than a flat chair back.

The method of constructing the chair described above is readily apparent from the above descriptions and the drawings. In summary:

Two lengths or pieces of rhomboidal tubing, of appropriate length, are selected for use in making the first and second rear support members 50 and 51 respectively. The two pieces are preferably of the same length. The three bends 56, 58 and 60 are made in each piece of tube. Preferably the bends are of the same degree, with bends 56 and 58 being in different planes as described above, and with bends 58 and 60 being in the same plane.

Suitable lengths of material are selected for use in preparing the front legs 13 of the chair. The front legs 13 and side extensions 16 are easily formed by introducing the single bend 101 into each length of tubing. Preferably bend 101 is approximately the same as any of the bends 56, 58, and 60 and may be made in the same die and bending apparatus. The front pieces 100 are mounted on the first and second rear support members 50 and 51 as by welding and an appropriate horizontal member 120 is prepared and welded to the top ends 121 and 122 of the rear support members 50 and 51 respectively. Central cross member 17 is welded between the side extensions 16, FIG. 2. The chair seat 4 and rear backrest panels 25 and 26 are mounted upon the frame 6. Other features such as stacking blocks 30 and glides 32 are added as desired. In the preferred embodiment, FIG. 1, a panel 130 is mounted underneath each side extension 116 to keep the bottom of the chair from being visible from the side.

Figure 10:
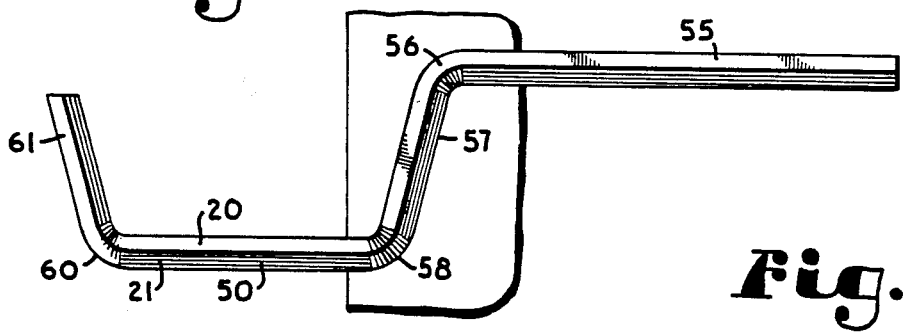
FIG. 10 is an enlarged top plan view of a rear support member which comprises a portion of a chair according to the present invention.

FIGS. 10 through 14 also depict rear support member 50, shown in FIGS. 2 and 4. In FIG. 10 the rear support member 50 is shown independent of a chair and its first lower extension 55, first bend 56, extension and transition portion 57, second bend 58, the extEnsion 21, in the upper back portion 20, are viewable. The third bend 60, to create the top extension 61, is also viewable.

Figure 13:
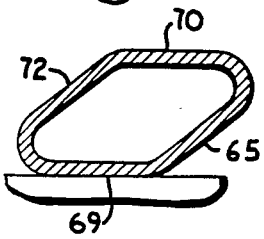
FIG. 13 is a cross-sectional view taken generally along either one of the pair of lines 13—13 in FIG. 11.
Figure 14:
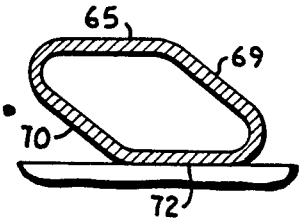
FIG. 14 comprises a cross-sectional view taken generally along either one of the pair of lines 14—14 in FIG. 12.
Figure 11:
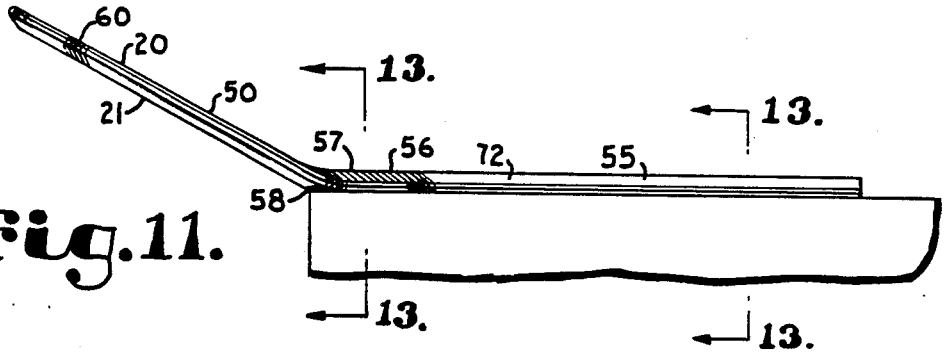
FIG. 11 is a side elevational view of the support member shown in FIG. 10 and depicted resting upon a first planar surface.

As previously described with respect to FIGS. 1 through 9, extension 50 to FIG. 10 is formed from tubing having a generally rhomboidal cross-section, FIGS. 3, 13 and 14. In FIGS. 11 and 13 the tubing is shown with its planar face 69, FIGS. 3 and 13, resting upon an imaginary planar surface. That is, the first bend 56, as is understood by references to FIGS. 2, 3, 4 and 11, is in the plane of surfaces 69 and 70. Thus, cross-section 13 looks the same from the point of view of either one of the pair of lines 13—13 in FIG. 11, that is regardless of whether it is taken before or after bend 56.

Figure 12:
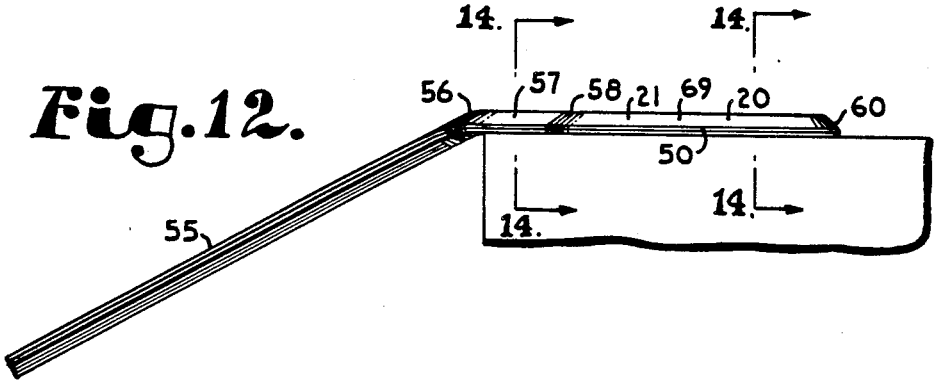
FIG. 12 is a side elevational view of the support member shown in FIG. 10, and depicted resting on a second planar surface.

FIG. 12 shows the same support member 50 resting upon imaginary plane abutting surface 72. That is, the plane of the second bend 58 is the plane of surfaces 65 and 72, FIG. 14. Thus, a cross-sectional view taken along either one of the pair of lines 14—14, FIG. 12, looks the same, that is regardless of whether takn before or after bend 58.

As a result of having the two bends 56 and 58, FIGS. 4 and 10, in different planes, the support member 50 includes a dihedral angle between extension 55 and extension 21, FIGS. 5, 11 and 12, which is controlled by the angle between the planes of the surfaces in which the two bends take place. Generally, the dihedral angle 40, FIG. 5, is substantially equal to an obtuse supplement of the acute angle between the faces in which the bends take place. For the rhomboidal tubing utilized in the preferred embodiment, this results in a dihedral angle 40 substantially equal to the obtuse internal angles of the rhomboid.

It is to be understood that while certain forms of the present invention have been illustrated and described herein, it is not to be limited to the specific forms or arrangement of parts described and shown.

What is claimed and desired to be secured by letters patent is as follows:

1. A chair comprising:
(a) a chair seat;
(b) a chair back;
(c) a chair frame having means for supporting said chair seat and chair back;
(i) said chair frame including front support means and at least one rear support member;
(ii) said rear support member including an elongate bar having a generally rhomboidal cross-section and having four planar longitudinal surfaces defining two substantially equal and opposite obtuse angles and two substantially equal and opposite acture angles, each angle being between adjacent planar surfaces;
(iii) said rear support member having a bent configuration including a lower leg portion, an upper back portion, and an intermediate transition portion; said upper back portion extending generally upwardly and forming a dihedral angle with said leg portion, said dihedral angle being substantially equivalent to one of said obtuse angles in that said intermediate transition portion is formed by a first bend in the plane of one of said planar longitudinal surfaces and a second bend in the plane of another of said planar surfaces extending at one of said obtuse angles to said first named plane;
(d) said rear support member upper back portion having said chair back mounted thereon;
(e) whereby an angle generally defined by the angle between general planes of extension of said chair back and said lower leg portion is dictated and controlled by said two opposite obtuse and said two opposite acute angles.

2. A chair comprising:
(a) a chair seat;
(b) a chair back;
(c) a chair frame having means for supporting said chair seat and chair back;
(i) said chair frame including front support means and first and second rear support members, said first and second rear support members being substantially mirror images of one another;
(ii) each rear support member being an elongate bar having a generally rhombial cross-section only having four planar longitudinal surfaces defining two substantially equal and opposite obtuse angles and two substantially equal and opposite acute angles, each angle being between adjacent planar surfaces;
(iii) each rear support member being of a bent configuration including a lower leg portion, an upper back portion, and an intermediate transition portion; said upper back portion extending generally upwardly an forming a dihedral angle with said leg portion, said dihedral angle being substantially equivalent to one of said obtuse angles in that said intermediate transition portion is formed by a first bend in the plane of one of said planar longitudinal surfaces and a second bend in the plane of another of said planar longitudinal surfaces extending at one of said obtuse sangles to said first named plane;
(d) said first and second rear support member upper back portions having said chair back mounted thereon;
(e) whereby an angle generally defined by the angle between general planes of extension of said chair back and said lower leg portions is dictated and controlled by said two opposite obtuse angles and said two opposite acture angles.

3. A chair according to claim 2 wherein:
(a) said first and second rear support members are laterally spaced from one another and are mounted with a plane-of-symmetry passing therebetween; and
(b) said chair back includes first and second laterally spaced back rest panels;
(i) said first rear support member upper back portion having said first backrest panel mounted thereon;
(ii) said second rear support member upper back portion having said second backrest panel mounted thereon.

4. A chair according to claim 3 wherein:

a. each of said first and second rear support member upper back portions include an outwardly extending top member;

b. said frame includes a horizontal support member mounted on and extending between said top members.

5. A chair comprising:

(a) a chair frame having a chair seat and chair back mounted thereon;

(b) said chair frame having first and second front legs and first and second rear support members, said rear support members being substantially mirror images of one another;

(i) said rear support members each being tubular with a rhomboidal cross-section and each having four planar longitudinal surfaces defining two substantially equal and opposite obtuse angles and two substantially equal and opposite acute angles, each angle being between adjacent planar surfaces;

(ii) said support members each having a bent configuration with a rear leg portion, an upper back portion and a central transition portion; said rear leg portions both extending generally rearwardly and downwardly from said chair seat; and, said upper back portions both extending generally upwardly and rearwardly from said chair seat; said upper back portion of each rear support member forming a dihedral angle with said rear leg portion of the same rear support member, said dihedral angle being substantially equivalent to one of said central obtuse angles in that said transition portion is formed by a first bend in the plane of one of said planar longitudinal surfaces and a second bend in the plane of another of said planar longitudinal surfaces extending at one of said obtuse angles to said first named plane; and (c) said chair back including first and second backrest panels;

(i) said first support member upper back portion having said first backrest panel mounted thereon; and said second support member upper back portion having said second backrest panel mounted thereon;

(d) whereby an angle generally defined by the angle between general planes of extension of said chair back and said rear leg portions is dictated and controlled by said obtuse and acute angles.

6. A chair according to claim 5 where in:

a. said front legs are tubular and have a rhomboidal cross-section;

(i) said front leg rhomboidal cross-section having two substantially equal and opposite obtuse angles and two substantially equal and opposite acute angles, b. said front legs extend generally downwardly and forwardly from said chair seat; and wherein c. said front leg rhomboidal cross-sections are oriented substantially at right angles to said rear leg portion rhomboidal cross-sections;

d. whereby said chair frame is substantially resistant to deformation from force directed toward said rear support member acute angles and also from pressure oriented toward said front leg acute angles.

7. A method of constructing a chair, said method including the steps of:

(a) providing first and second substantially identical pieces of tubular material, each piece having a substantially rhomboidal cross-section and four planar longitudinal surfaces defining first and second substantially equivalent and opposite obtuse angles and first and second substantially equivalent and opposite acute angles;

(i) each tubular piece having first and third opposite and parallel flat outer surfaces and second and fourth opposite and parallel flat outer surfaces;

(b) providing a first bend in said first tubular piece in the planes of said first and third flat outer surfaces;

(c) providing a second bend in said first tubular piece in the planes of said second and fourth flat outer surfaces;

(i) said second bend being opposite and generally equivalent to said first bend, thereby forming an S-like configuration in a portion of said flat tubular piece with a lower leg extension, an intermediate transition extension and an upper back extension being formed; said upper back extension forming a dihedral angle with said lower leg extension, said dihedral angle being generally dictated by said angles of said first tubular piece in that said transition extension is formed by a first bend in the plane of one of said intermediate planar longitudinal surfaces and a second bend in the plane of another of said planar longitudinal surfaces extending at one of said obtuse angles to said first named plane;

(d) bending said second tubular piece in a manner similar, and generally opposite, to said first tubular piece, to conform said second tubular piece into a substantial mirror image of said first tubular piece;

(e) providing first and second front leg extensions;

(f) assembling a chair frame including orienting said first and second tubular pieces with said lower leg extensions forming rear legs, and mounting said front leg extensions to form front legs;

(i) said upper back extensions extending generally upwardly, and rearwardly;

(g) mounting a chair seat on said chair frame;

(h) mounting a chair backrest on said upper back extensions; and (i) whereby a chair is constructed with a chair bachrest extending at a preselected angle with respect to rear legs of said chair, said preselected angle being controlled by said angles between said flat surfaces of said first and second tubular pieces.

8. A chair made according to the method of claim 7.

9. The method of claim 7 wherein:

(a) said first and second front leg extensions are tubular and have a rhomboidal cross-section defining substantially equal and opposite obtuse angles and equal and opposite acute angles;

(i) said front leg extension being formed from tubular material substantially identical to said tubular material used to form said first and second pieces; and (b) said first and second front leg extensions being oriented with their rhomboidal cross-sections at generally right angles to said rear leg rhomboidal cross-sections;

(i) said rear legs oriented with said obtuse angles oriented forwardly and rearwardly;

(c) whereby said chair frame rear legs are substantially resistant to deformation from force oriented laterally of said chair frame; and (d) whereby said chair frame front legs are substantially resistant to deformation from force oriented against said chair frame from a front or rear thereof.

10. A chair made according to the method of claim 9.

11. The method of claim 7 including:

a. mounting said first and second tubular pieces with said upper back extensions substantially near, aligned with, and spaced apart from one another;

b. providing first and second chair back panels to form said chair backrest;

(i) said first chair back panel being mounted on said first tubular piece upper back portion; . and (ii) said second chair back panel being mounted on said second tubular piece upper back portion, said second chair back panel being laterally spaced from said first chair back panel;

c. whereby said chair back includes a ventilation space therein.

12. The method of claim 11 including:

a. providing an upper back portion top end outer lateral extension on each of said first and second tubular pieces; and b. mounting a horizontal structural member on, and extending between, said upper back portion top end outer lateral extensions.

13. A chair made according to the method of claim 12.

14. A chair made according to the method of claim 11.

15. A chair comprising:

(a) a chair seat;

(b) a chair back;

(c) a chair frame having means for supporting said chair seat and chair back;

(i) said chair frame including front support means and at least one rear support member;

(ii) said rear support member comprising an extension of tubing having at least first and second longitudnal planar surfaces; said first and second planar surfaces being generally adjacent and forming an obtuse angle with respect to one another;

(iii) said rear support member having a configuration including a lower leg portion, an upper back portion and an intermediate transition portion extending between said lower leg and said upper back portions; said intermediate transition portion including first and second bends therein, said first bend being in a plane of said first planar surface and said second bend being in a plane of said second planar surface, said upper back portion extending generally upwardly and forming a dihedral angle with said leg portion, said dihedral angle being substantially equal to said obtuse angle in that said transition portion is formed by a first bend in the plane of one of said planar longitudinal surfaces and a second bend in the plane of another of said planar longitudinal surfaces extending at one of said obtuse angles to said first named plane;

(d) said rear support member upper back portion having said chair back mounted thereon;

(e) whereby an angle generally defined by the angle between the general planes of extension of said chair back and said lower leg portion is dictated and controlled by obtuse angle between said first and second planar surfaces.

16. A chair comprising:

(a) a chair seat;

(b) a chair back;

(c) a chair frame having means for supporting said chair seat and chair back;

(i) said chair frame including front support means and first and second rear support members, said first and second rear support members being substantially mirror images of one another;

(ii) each rear support member comprising an extension of tubing having at least first and second longitudinal planar surfaces; said first and second planar surfaces for each support member being generally adjacent and forming an obtuse angle;

(iii) each rear support member having a configuration including a lower leg portion, an upper back portion and an intermediate transition portion extending between said lower leg and said upper back portions; said intermediate transition portion of each support member including first and second bends therein, said first bend being in a plane of said first planar surface and said second bend being in a plane of said second planar surface; said upper back portion extending generally upwardly and forming a dihedral angle with said lower leg portion, said dihedral angle being substantially equivalent to said obtuse angle in that said transition portion is formed by a first bend in the plane of one of said longitudinal planar surfaces and a second bend in the plane of another of said longitudinal planar surfaces extending at one of said obtuse angles to said first named plane;

(d) said first and second rear support member upper back portions having said chair back mounted thereon;

(e) whereby an angle generally defined by the angle between the general planes of extension of said chair back and said lower leg portions is dictated and controlled by said obtuse angle between said first and second planar surfaces of each rear support member.

17. A chair according to claim 16 wherein:

(a) said first and second rear support members are laterally spaced from one another and are mounted with a plane-of-symmetry passing therebetween; and, (b) said chair back includes first and second laterally spaced backrest panels;

(i) said first rear support member upper back portion having said first backrest panel mounted thereon; and (ii) said second rear support member upper back portion having said second backrest panel mounted thereon.

18. A method of constructing a chair, said method including the steps of:

(a) providing first and second substantially identical pieces of tubular material, each piece having first and second adjacent longitudinal planar surfaces; said first and second planar surfaces of each of said pieces of tubular material forming an obtuse angle with respect to one another;

(b) providing a first bend in said first tubular piece in the plane of said first planar surface;

(c) providing a second bend in said first tubular piece in the plane of said second planar surface;

(i) said second bend being generally opposite in direction to said first bend, thereby forming a generally S-like configuration in a portion of said first tubular piece with a lower leg extension, an intermediate transition extension and an upper back extension; said upper back extension forming a dihedral angle with said lower leg extension, said dihedral angle being generally equal to said obtuse angle in that said transition extension is formed by a first bend in the plane of one of said longitudinal planar surfaces and a second bend in the plane of another of said longitudinal planar surfaces extending at one of said obtuse angles to said first named plane;

(d) bending said second tubular piece in a manner similar, and opposite to said first tubular piece, to conform said second tubular piece into a substantial mirror image of said first tubular piece;

(e) providing first and second front leg extensions;

(f) assembling a chair frame including orienting said first and second tubular pieces with said lower leg extensions forming rear legs, and mounting said front leg extensions to form front legs;

(i) said upper back extensions of each tubular piece extending generally upwardly and rearwardly;

(g) mounting a chair seat on said chair frame;

(h) mounting a chair backrest on said upper back extensions; and (i) whereby a chair is constructed with a chair backrest extending at a preselected angle with respect to rear legs of said chair, said preselected angle being generally controlled by said angles between said flat surfaces of said first and second tubular pieces.

19. A chair made according to the method of claim 18.

* * * * *